US007712643B2

(12) United States Patent
Papernik

(10) Patent No.: US 7,712,643 B2
(45) Date of Patent: May 11, 2010

(54) JEWELRY FASTENING AID

(76) Inventor: Karen Papernik, 25 Phillard Ct., Patterson, NY (US) 12563

( * ) Notice: Subject to any disclaimer, the term of this patent is extended or adjusted under 35 U.S.C. 154(b) by 349 days.

(21) Appl. No.: 11/538,707

(22) Filed: Oct. 4, 2006

(65) Prior Publication Data

US 2007/0074375 A1 Apr. 5, 2007

Related U.S. Application Data

(60) Provisional application No. 60/723,691, filed on Oct. 5, 2005, provisional application No. 60/762,810, filed on Jan. 27, 2006.

(51) Int. Cl.
*A47G 25/80* (2006.01)

(52) U.S. Cl. ..... 223/111

(58) Field of Classification Search ..... 223/111, 223/DIG. 2

See application file for complete search history.

(56) References Cited

U.S. PATENT DOCUMENTS 1,841,291 A * 1/1932 Kern ..... 132/75
4,219,919 A * 9/1980 Fischbein et al. ..... 29/270
4,650,141 A * 3/1987 Longo et al. ..... 248/118
4,734,973 A * 4/1988 Longo et al. ..... 29/428
5,405,066 A * 4/1995 Fakier ..... 223/111
5,709,327 A * 1/1998 LaMacchia et al. ..... 223/111
5,741,035 A * 4/1998 Glass ..... 294/1.1
5,855,401 A * 1/1999 Papernik ..... 294/2
5,899,369 A * 5/1999 Macripo ..... 223/111
5,934,526 A * 8/1999 Rosenbaum et al. ..... 223/111
6,032,996 A * 3/2000 Kogen ..... 294/2
6,036,065 A * 3/2000 Wofford et al. ..... 223/111
6,484,910 B1 * 11/2002 Korkos ..... 223/111
6,854,625 B2 * 2/2005 Tedeschi ..... 223/111
2007/0074375 A1 * 4/2007 Papernik ..... 24/1

* cited by examiner

*Primary Examiner*—Shaun R Hurley
*Assistant Examiner*—Andrew W Sutton
(74) *Attorney, Agent, or Firm*—Lackenbach Siegel, LLP; Myron Greenspan

(57) ABSTRACT

A jewelry fastening aid assists a user in readily and securely joining disparate flexible ends of bracelets about the user's own wrist. The device provides a substantial improvement over related articles attempting to serve a related need but which are limited in application to slip-clasps. A rotatable and pivotable clamping assembly enables hands-free engagement with spring-clamp clasps, and holds spring clamp-clasps securely in an open position by engaging and retaining a tensioned opening-lever in an open position while simultaneously locking a spring-clamp body relative to the clamping assembly.

15 Claims, 8 Drawing Sheets

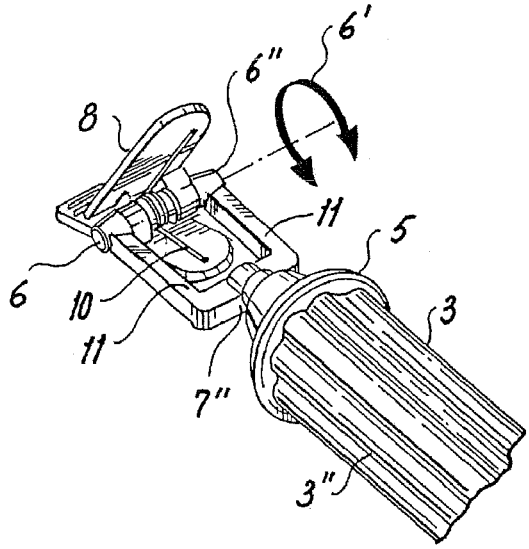
Fig. 2
Fig. 3
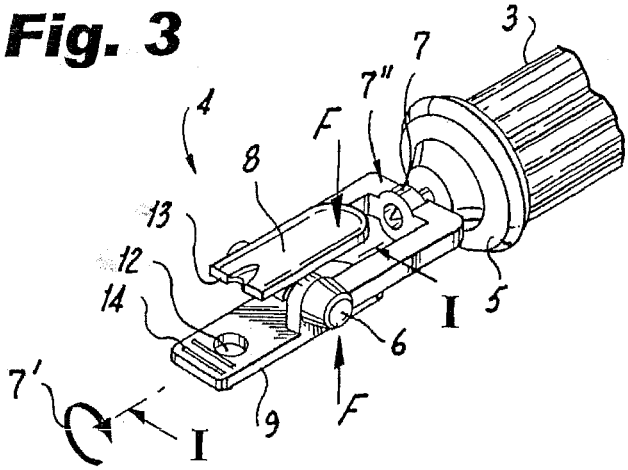
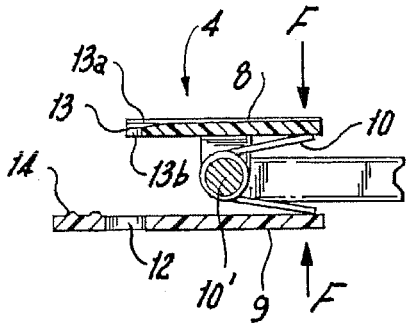
Fig. 4
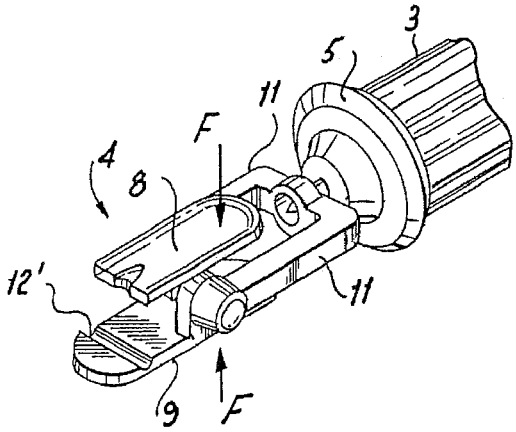
Fig. 5

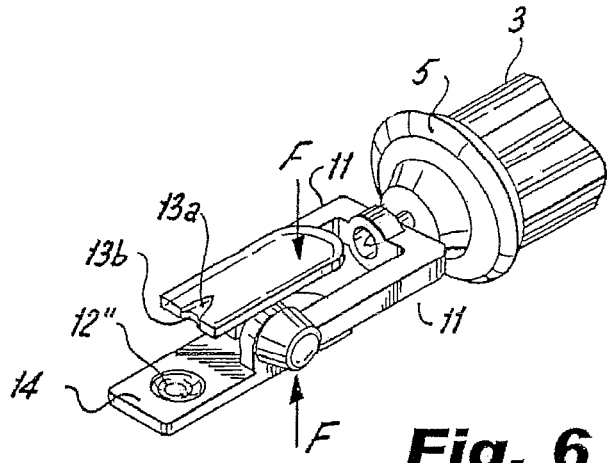
Fig. 6
Fig. 7
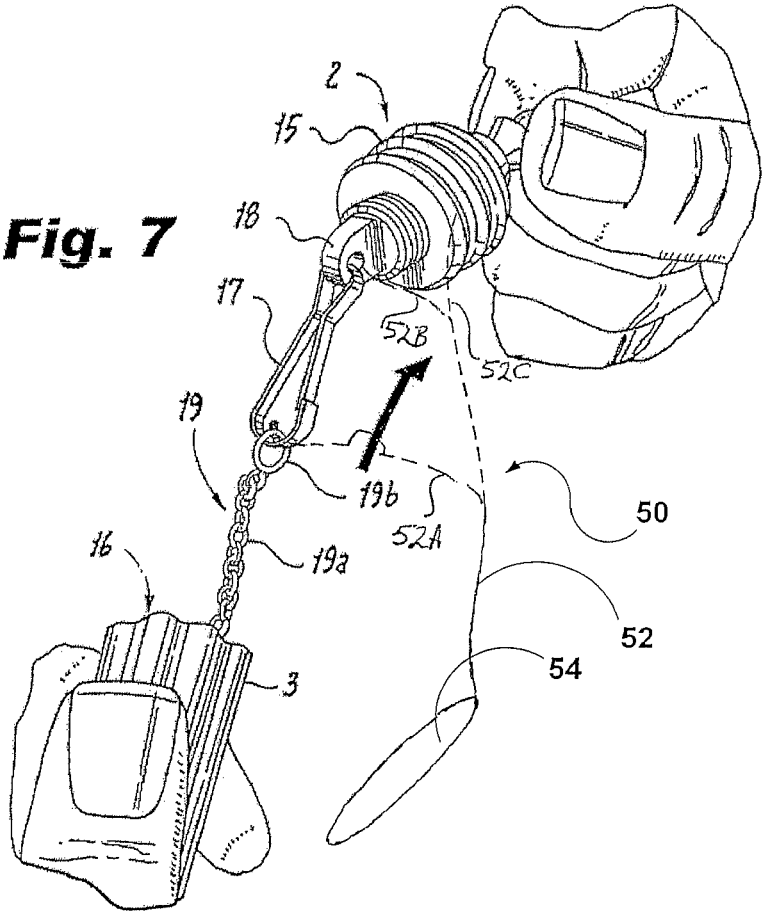

Fig. 11
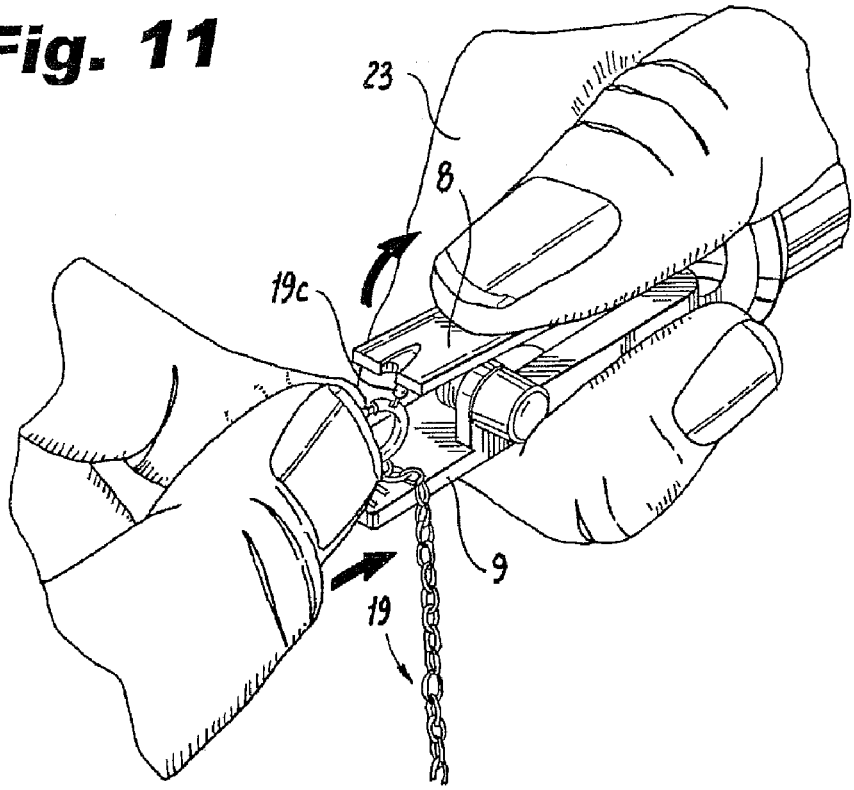
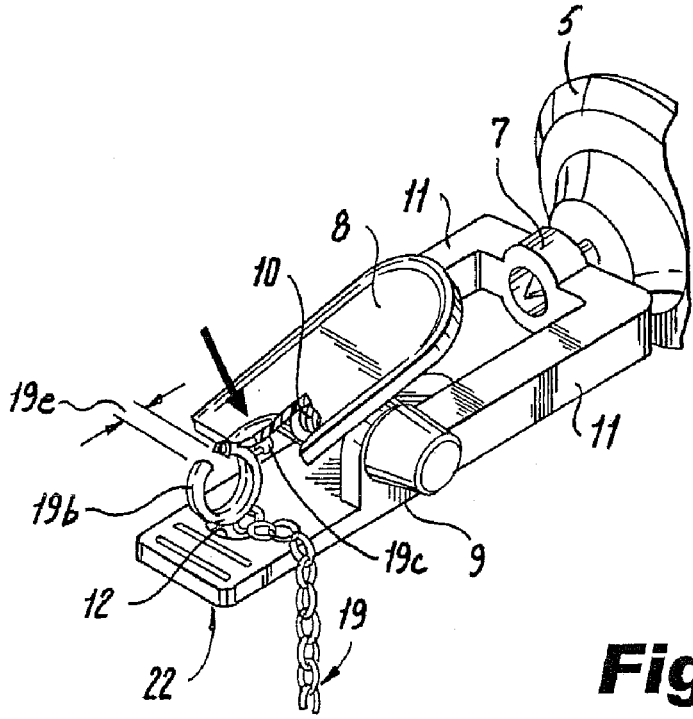
Fig. 12

JEWELRY FASTENING AID

CROSS REFERENCE TO RELATED APPLICATIONS

This application is based on and claims priority to U.S. Provisional Patent App. Ser. No. 60/723,691 filed Oct. 5, 2005, and U.S. Provisional Patent App. Ser. No. 60/762,810 filed Jan. 27, 2006, the contents of each of which are herein fully incorporated by reference.

BACKGROUND OF THE INVENTION

1. Field of the Invention

The present invention relates to a hand held fastening aid for disengagingly coupling male and female members of a fastening unit. More specifically, the present invention relates to a jewelry piece fastening aid which enables hands-free engagement with a fully adaptable spring-clasp or spring-clamp member to aid a user in securing jewelry about a user's own body.

2. Description of the Related Art

Jewelry, such as rings, brooches, necklaces and bracelets is widely used by women and men for ornamentation and particularly bracelets or ornamental bands or chains or strings are worn about a person's limbs. While bracelets are formed of many materials and applications are varied, it is quite common to understand that at the end of each bracelet or necklace or clasp there is some type of engagement mechanism. Such engagement mechanisms are alternatively referred to herein as clasps and have a first interlocking member and a second related interlocking member.

Typical clasps with first and second interlocking members often include spring biased interlocking members each of which is attached with (commonly) a slip lever and a receiving opening. Such bracelets are referred to in U.S. Pat. No. 5,709,327 to LaMacchia et al (entitled Bracelet Fastening Device) the entire contents of which are herein incorporated by reference. The LaMacchia patent refers to a bracelet-fastening device having a hand held member in an end clasping assembly. The LaMacchia patent is a division of U.S. patent application Ser. No. 08/400,024 filed Mar. 6, 1995, the entire contents of each of which are herein incorporated by reference.

In typical clasps either one of the receiving or mating members can be operated by hand to release the other. A mating member interlocks with a receiving member to connect the two ends of the bracelet together. Various configurations of releasable clasps have been devised for connecting the ends of bracelets and necklaces together and retain them around a person's limbs.

A major problem with a bracelet having a releasable spring clasp, and particularly spring ring and lobster type clasps is the effort required by a person to easily and quickly fasten a bracelet around their wrist. In manually fastening a bracelet around one's wrist an individual to exhibit great dexterity where there is no third hand or assistant available to engage and position the spring clasp, particularly where the user faces a physical disability that challenges dexterity.

For example, where there is no retaining assistant hand, first a user's hand adjoining the wrist upon which the bracelet is to be worn is often of no help manipulating the clasp and the person must instead solely use one hand opposite to the wrist from which the bracelet is to be worn to hold the first interlocking member in place while attempting to swing or position or juggle the second interlocking member into an advantageous spring lock engagement position while simultaneously actuating a lever-release for a spring-clasp. Frequently a person needs to try several times in order to successfully grasp the clasp of a bracelet when attempting to fasten it around their limb without the assistance of a third hand.

In particular the LaMacchia reference discloses in the figures an embodiment that includes a U-shaped claw ratting member that is springably engaged to bring two parallel surfaces into a gripping orientation. This gripping orientation is disclosed as engaging parallel flat sides of a female or male bracelet end.

During operation the LaMacchia patent teaches the grasping of the female parallel sided bracelet clasp and holding an engageable body member with the bracelet hand while using an alternative hand to laterally slide a male positioning member within the female clasp receiving cavity. As taught, the clamping assembly in the LaMacchia device is unable to retain spring clamps or lobster type clamps known in the prior art in an open and engageable position because it fails to engage the spring levers of the clasp type and simultaneously fails to retain the spring clamp clasp body relative to the spring lever, thereby forcing a user to employ their fingers and fingernails to maintain a delicate balance to hold the clip open.

As noted, it should be known to those familiar with spring clamp clasps that it is necessary to both simultaneously engage a spring clamp release lever, engage the lever, operate the lever against an internal spring bias and open a receiving slot, and stabilize and retain the spring clamp clasp body to enable relative motion of the spring clamp lever. The LaMacchia device fails to enable any of these requisite steps in engaging a "spring ring type clasp" or a "lobster claw type clasp".

Similar problems are faced by a user attempting to button up a piece of his/her wardrobe. In particular, a person with impaired fine motor skills may experience difficulty while engaging a button in a loop, and may require the assistance of a mechanical device to aid the process.

Therefore there is a need for a jewelry fastening aid to enable the user to readily grasp and operate spring ring and lobster claw type clasp mechanisms for bracelets and other jewelry.

OBJECTS AND SUMMARY OF THE INVENTION

An object of the present invention is to provide at least one jewelry fastening aid that responds to one of the needs noted above.

Another object of the present invention is to provide a jewelry fastening aid which enables ready clasping and engaging of the spring ring and lobster claw spring clasp type mechanisms.

Yet another object of the present invention is to provide a jewelry fastening aid enabling a single user to grasp and actuate and retain in an open position a spring ring or spring lobster claw type clasp thereby readily enabling a user to hold in an engaged and open position such a spring clasp and thereby readily allow one handed application of bracelets and necklaces.

It is another object of the present invention to provide such a jewelry fastening aid for use by a person with impaired fine motor skills in which the device assists in fastening a bracelet around one's wrist.

It is another object of the present invention to provide a jewelry fastening aid that employs a pivoting and re-positionable clamping member relative to a body-holding member, wherein convenient holding angles may be established for a user.

It is another object of the present invention to provide such a jewelry fastening device that holds one of two interlocking members forming a clasp of a bracelet so that the engaged clasp member may be retained in a sprung-open position enabling single hand engagement.

It is another object of the present invention to provide such a jewelry fastening aid that is simple in construction and which may be manufactured readily and inexpensively.

It is another object of the present invention to provide a jewelry fastening aid that includes one and optionally two or more accessible storage cavities.

It is another object of the present invention to provide a jewelry fastening aid with at least one storage cavity including one of an anti-tarnishment and a polishing material in a removable-replaceable form or a presently-fixed form.

It is yet another particular object of the present invention to provide such a jewelry fastening aid with a clamping assembly composed of biased releasable clamping jaw members which have a jewelry-scratch resistance construction, namely plastic or ceramic coated metal or other soft resilient and yet firm composition, so as to thereby eliminate scratching and damage of jewelry during assembly.

The present invention relates to a jewelry fastening aid assists a user in readily and securely joining disparate flexible ends of bracelets about the user's own wrist. The device provides a substantial improvement over related articles attempting to serve a related need but which are limited in application to slip-clasps. A clamping assembly enables hands-free engagement with spring-clamp clasps, and holds spring clamp-clasps securely in an open position by engaging and retaining a tensioned opening-lever in an open position while simultaneously locking a spring-clamp body relative to the clamping assembly.

The above, and other objects, features and advantages of the present invention will become apparent from the following description read in conduction with the accompanying drawings, in which like reference numerals designate the same elements.

BRIEF DESCRIPTION OF THE DRAWINGS

FIG. 2 is a partial perspective view of a clamping assembly of a jewelry fastening aid according to the embodiment of the present invention shown in FIG. 1.

FIG. 3 is a top perspective view of the clamping assembly shown in FIGS. 1 and 2.

FIG. 4 is a cross-sectional partial view along section lines I-I.

FIG. 5 is an alternative embodiment of the clamping assembly shown in FIG. 3.

FIG. 6 is another alternative embodiment of the clamping assembly shown in FIG. 3.

FIG. 7 shows a partially disassembled perspective view of the tail assembly of the jewelry fastening aid of the present invention.

FIG. 11 is a partially assembled view according to one embodiment of the present invention. (Step 2)

FIG. 12 shows a partially grasping view. (Step 3)

DETAILED DESCRIPTION OF THE PREFERRED EMBODIMENTS

Figure 1:
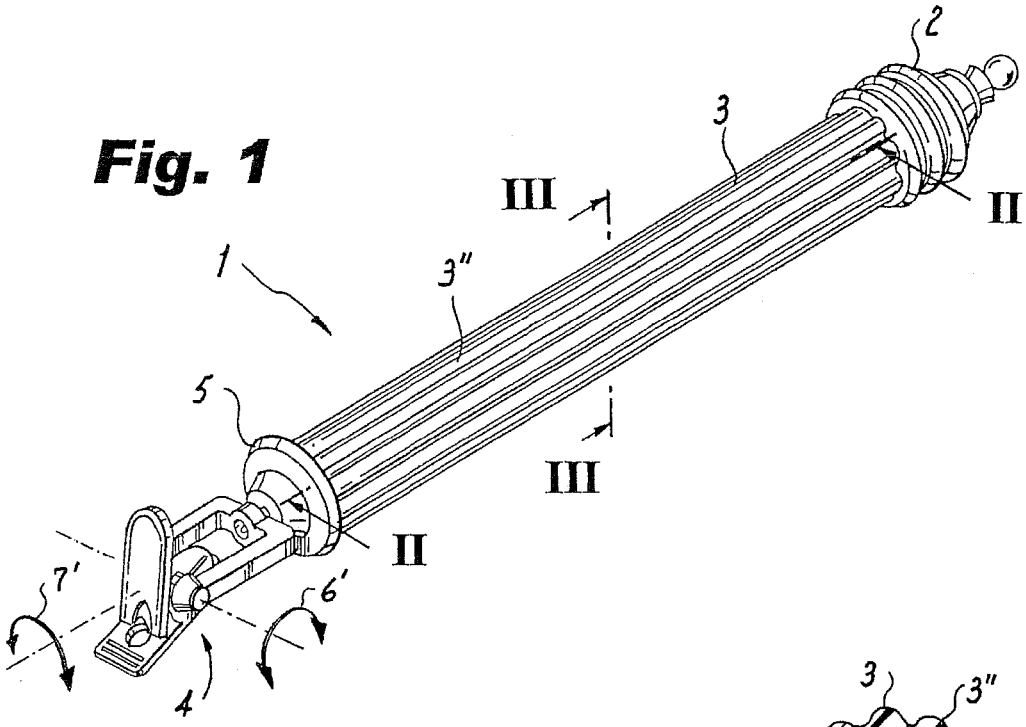
FIG. 1 is a perspective view of a jewelry fastening aid according to one embodiment of the present invention.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

Referring now to FIGS. 1 through 6, a fastening device 1 includes a main body member 3 joining a tail member 2 and a clamping member or clamping assembly 4. Clamping member 4 is engaged with body member 3 via a head member 5 as shown. Clamping member 4 and head member 5 are threadably engaged with body member 3 via a plurality of threaded engagement grooves 15B (see FIG. 1A). As disclosed in FIG. 1A, threadably attached head member 5 and clamping member 4 threadably and releasably engage body member 3 to enclose head cavity 16B for convenient storage of the removable head member 5 and clamping member 4.

The configuration of head member 5 is not limited to a generally frustoconical shape as shown in FIGS. 1-6. Accordingly, in an alternative embodiment (not shown), head member 5 may have its opposite ends configured to selectively fit the interior of head cavity 16B (FIG. 1B). This configuration would allow a user to unscrew head and clamp members 5 and 4, respectively, when fastening device 1 is not in use, and reverse its orientation noted in FIG. 1. As a consequence, clamping member 4 can be securely housed within body 3 of device 1 and, thus, breakage-protected when device 1 is not used (for example during transit). To prevent voluntary displacement of clamping member 4 from cavity 16B in a non-use position of device 1, the outer surface of head member 5 may be provided with threads on its outer surface (not shown) engaging threads 15*b* of FIG. 1A.

As depicted most precisely in FIG. 2, device 1 is configured to allow a user to adjust a position of clamping member 4 relative to head member 5 when device 1 is in use. On one hand, clamping member 4 has an axial rotation assembly 7 operative to rotate member 4 about a longitudinal axis 7'

(FIGS. 1A and 3) of body 3. The axial rotation assembly 7 has a plurality of supporting arms 11, 11 coupled to perpendicular assembly 6 so as to enable a complete 360° rotation of clamping member 4 about longitudinal axis 7' of body 3 in response to a torque applied by the user.

Axial rotation assembly 7 is shown with an optional axial rotation stop mechanism 7" rotatably fixed to arms 11 and rotatably coupled to head member 5. As noted, the stop mechanism 7" enables clamping member 4 to rotate at a full 360° angle about longitudinal axis 7' and prevents involuntary displacement of member 4 about axis 7" after the desired angular position of member 4 is established. On the other hand, clamping member 4 includes a perpendicular rotation or 360° pivot assembly 6 having a rotation stop assembly 6" which enables first and second jaws 8 and 9 of clamping member 4, respectively, to pivot synchronously relative to arms 11 about a pivot axis 6' which extends substantially perpendicular to longitudinal axis 7'. As diagrammatically shown in FIG. 3, a first hinge-shaped extension 9 of clamping member is rotatably mounted to pivot assembly 6 to provide relative angular displacement between clamping member 4 and arms 11, 11 about pivot axis 6'. Alternatively speaking, arms 11, 11 may be rotatably mounted to pivot assembly 6 which would allow clamping member 4 and arms 11 to pivot relative to one another about axis 6'. The 360° rotational and pivoting adjustability of clamping member 4 relative to body 3 allows a person, holding device 1 in one hand, to conveniently position clamping member 4 relative to a piece of jewelry and swiftly engage the spring clasp mechanism of the jewelry by clamping member 4.

As can be readily conceived by one of ordinary skills, clamping member 4 and head member 5 may be manufactured as two separate components displaceably coupled to one another. Alternative embodiments are envisioned that fix clamping member 4 relative to a simplified head member 5, thereby reducing manufacturing costs and damage (as will be discussed).

Referring to FIG. 4, clamping member 4 has a first clamping jaw 8 and a second clamping jaw 9 engageably pivoted relative to one another about a pivot member 10' extending along axis 6' of assembly 6. Pivot member 10' secures a biasing spring member 10 urging against extensions of first and second clamping jaws 8, 9, respectively, to urge the clamping members into a closed position, as shown in FIG. 4.

Figure 1B:
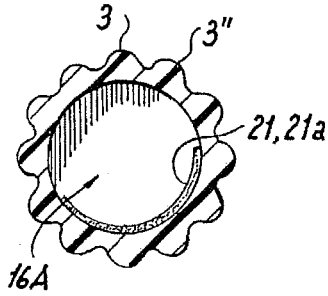
FIG. 1B is a cross-sectional view of FIG. 1 along section III-III.

As shown in FIG. 1, clamping member 4 has a positioning structure including an optional opening 12 and structure formations 14 provided on the tipped region of second clamping member 9. The opening 12 is dimensioned to provide a receiving and securing seat for a segment of jewelry piece, while formation 14 enhances friction between the wearer's finger and the surface of clamping member 9. FIG. 5 illustrates an alternative positioning structure 12' configured as a generally U-shaped recess which is dimensioned to provide a seat for pieces of jewelry. Yet another alternative positioning structure 12", as shown in FIG. 6, operates to engage the clasp member and is configured as an indent or opening having a generally frustoconically shaped cross-section.

Returning to FIG. 4, clamping member 4 further has a gripping structure 13 for actuating a clasp mechanism of a piece of piece of jewelry and fixing the latter to clamping member 4 in the desired position established by the wearer. The gripping structure 13 is formed on a tipped region of first clamping jaw 8 and includes a slope region 13*a* at a distal region of slot 13*b*. The positioning structures 12, 12' and 12" each and gripping structure 13, in combination, form a stabilizing and holding mechanism or means operative to resist the unintended reorientation and removal of a spring portion of a clasp member of jewelry piece in an open position. As can be clearly seen in FIG. 4, not only clamping members or jaws 8 and 9, respectively, are operative to pivot relative tone another, but also the jaws are operative to pivot 360° as a unit relative to the rest of device 1.

Figure 1A:
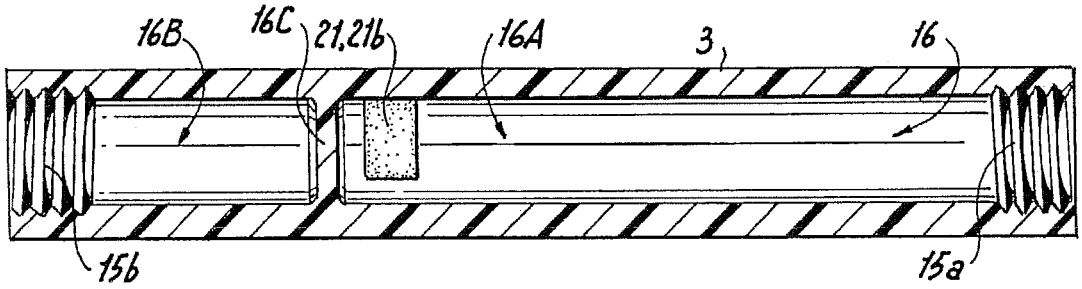
FIG. 1A is a cross sectional view of FIG. 1 along section II-II.

Referring to FIGS. 1A and 7, tail member 2 includes a plurality of threaded members 15 (FIG. 7) about an outer circumference. Threads 15 engage within an inner sidewall receiving threads 15*a* (FIG. 1B) in body member 3 forming a tail cavity or tail receptacle 16A. A bounding region 16C separates cavity 16B and 16A. In an alternative construction, bounding region 16C may be optionally removed by manufacturer forming a single continuous cavity for convenient jewelry storage or other purpose.

In one adaptive embodiment a tarnish reducing agent or composition or an anti-tarnishing claw or paper material may be positioned within cavity 16 and optionally within divided cavities 16*a*, 16*b* (FIG. 1A). Anti-tarnishment or anti-desiccant item 21 is shown as either a monolithic shape 21*b* or a flexible sheet material 21 a positioned within cavity 16A (FIG. 1B).

It should be understood by those of skill in the art that alternative types of anti-tarnishment and/or desiccant and/or cushioning or polishing materials may be positioned or stored within cavities 16, 16*a*, and 16*b* to the advantage of the user.

As is best shown in FIG. 7, a clip 17 is pivotably affixed to tail member 2 by a clip holder 18 and includes a retaining flexible limb. A spring based bracelet or necklace 19 having a chain 19*a* and a spring ring 19*b* may be easily retained and removed stored within cavity 16 for convenience. It is collectively referenced for convenience herein that any spring ring or spring type bracelet clasp may be referred to as a spring clamping or spring clamp embody.

Figure 9:
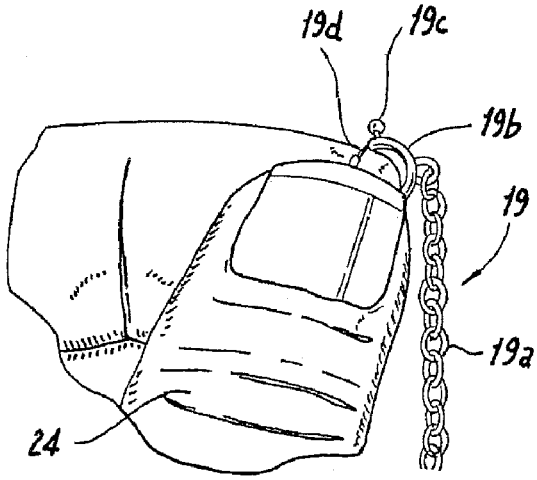
Fig. 9 (Prior Art)
FIG. 9 is a close-up view of a user holding one embodiment of a spring ring device in accordance with a known prior art. (Step 1)

A piece of jewelry may be configured, for example, as a bracelet. The bracelet includes a spring based piece hereinafter collectively referred to as clasp 19, a lever 19*c* extending to an outer periphery of spring ring 19*b* and shown in FIGS, 10, 11 and 12. In the known prior art, as shown in FIG. 9, actuation of lever 19*c* against an internal biasing means (not shown) is realized solely by the user's finger nail. In contrast, inventive device 1 is configured so that the movement of lever 19*c* relative to a gate 19*b* results in exposing an opening region 19*d* for engaging an opposing engagement member of clasp 19 as realized by clamping member 4.

Figure 8:
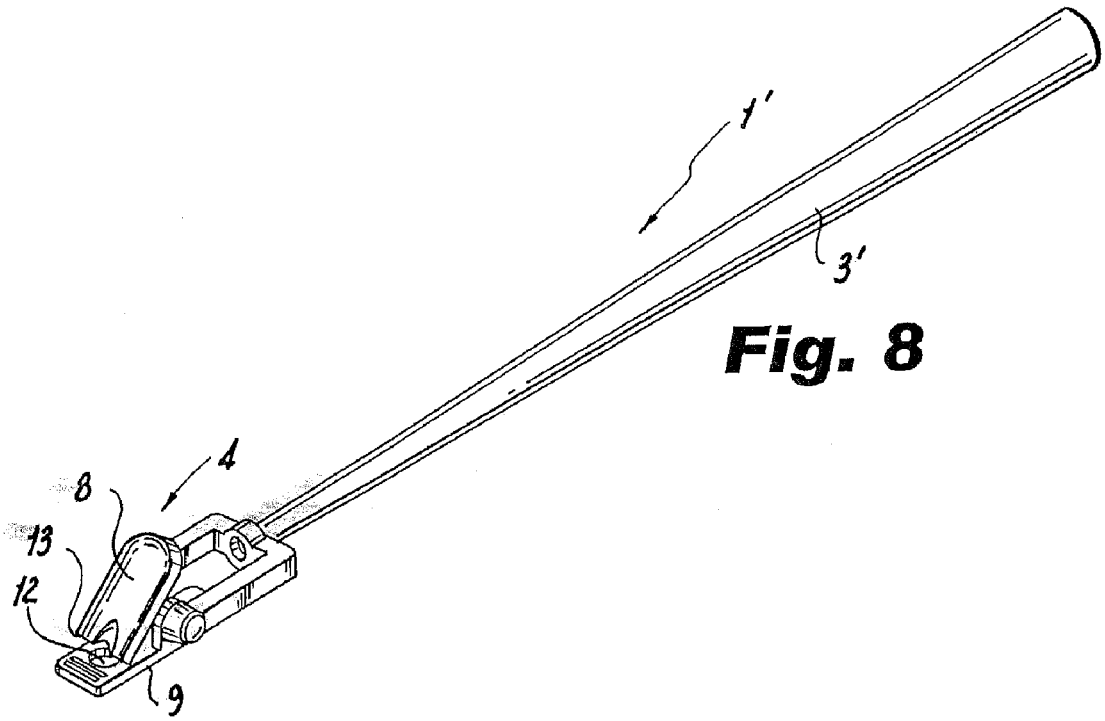
FIG. 8 shows an alternative embodiment of the present invention.

FIG. 8 illustrates one alternative embodiment to inventive device 1' including a monolithic body member 3' wherein head member 5 is replaced by a rigid single grasping member or handle for user convenience. The replacement of body member 3 with simplified body member 3' enables substantial reduction in cost savings and convenience in assembly for particular markets.

Referring now to FIGS. 10 through 16, spring clamp body 19*b* of spring clamp 19 may be releasably engaged within stabilizing and clamping means including positioning structure 12 and gripping structure 13.

During operation force may be applied (see FIG. 10) on distal ends of clamping members 8 and 9 thereby separating proximate ends of clamping jaws 8 and 9 for engagement with spring ring 19*b* and lever 19*c*. As can be shown, the rounded body of spring clamp body member 19 is easily received within positioning structure 12 in a manner which enables chain 19a to slope over an end of positioning structure 12 allowing free swing of the chain end.

Figure 10:
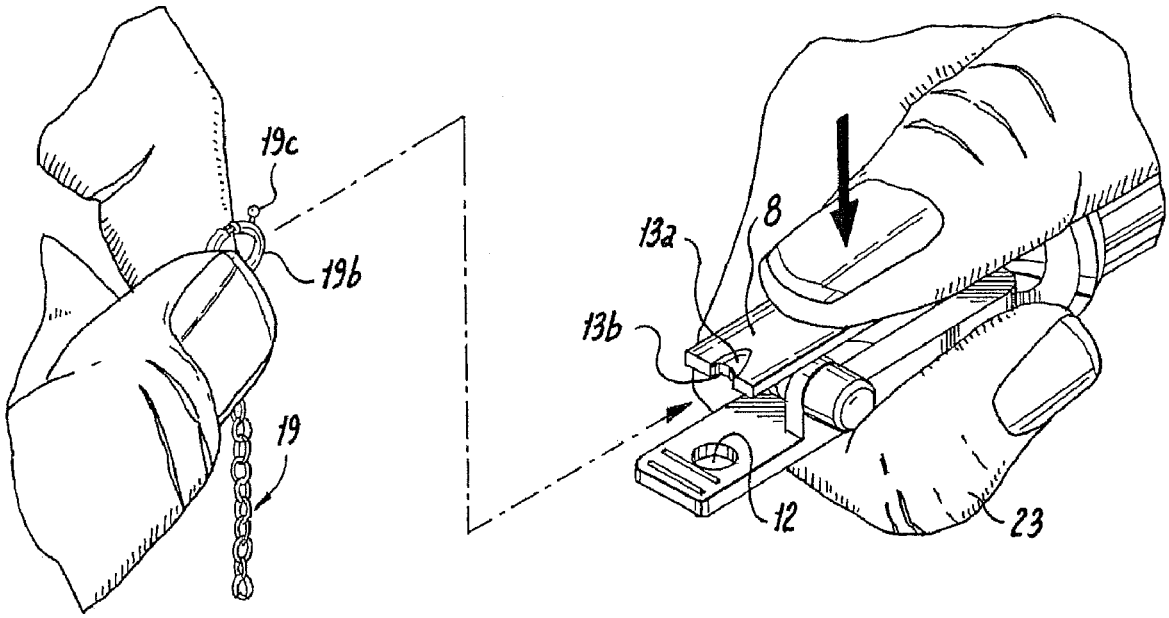
FIG. 10 is an assembly view of the jewelry fastening aid according to the present invention. (Step 1)

As is also clear from FIG. 10 and FIGS. 11 and 12 that gripping structure 13 engages slot 13*b* to engage lever 19*c* whereby biasing spring member 10 urges gripping structure 13 into actuation of lever 19*c* while sidewalls of slot 13*b* positively engage opposing sides of spring ring 19*b* and prevent its unintended lateral displacement. Simultaneously, positioning or retaining structure 12 (including alternative designs for positioning structures 12' and 12") grip a bottom opposite portion of spring ring 19*b* opposite lever 19*c* for positive clamp engagement of spring ring 19*b* within the stabilized and actuation means as claimed. As a result, bracelets may be easily (and securely) swung about a user's wrist for easy wear retaining the clip open in a ready-to-receive condition.

During this engagement, as is clear to those familiar with the art, opening 19*e* is formed proximate gate 19*d* by actuation of lever 19*c* for ready engagement with a free end of clasp 19. As shown in FIG. 12, the spring based bracelet or necklace is retained in an open position shown at 22 (FIG. 12) and a hand or finger 23 may be removed while spring ring 19*b* is retained securely and reliably in an open position.

Thus, while conventionally the user's fingernails are commonly used to actuate lever 19*c* to open gate 19d, this has proven unsatisfactory to the art and inventive device 1 enables achievement of the same goal is provided herein in a secure and reliable manner by manipulating clamp member 19 without having the user's hand directly on lever 19*c*. Therefore those skilled in the art will readily recognize that the present invention provides substantial advantages to the earlier hand-process, particularly for users with physical challenges, those of older years, those lacking fine muscle control and those with arthritis or other medical conditions preventing them from manipulating finely mechanical parts and thereby assemble jewelry items. This is of particular advantage as well to those having particular disabilities to one hand.

For example, those having a disability or in fact the amputation of one arm may wish to employ fastening device 1 to engage the spring ring mechanism of the necklace, hold the device in their teeth via body member 3 or other area and use their remaining free limb to grasp the opposite end of clasp 19 and position it within opening 19*e* and release spring ring 19*b* to readily engage a bracelet or necklace with a one-handed operation.

It should be clear to those with skill in the art that using the present invention while most convenient to the use two hands for the manipulation of fastening device 1, fully enables single-handed use where an alternative means (teeth) is available to secure a body member 3 during the initial and post engagement of spring ring 19*b* or spring clamp body 19*b* within the stabilizing and holding mechanism formed by gripping surfaces 13 and positioning structures 12.

In FIG. 7, for example, it will be recognized that fixing mechanisms 17, 18 may be substituted with differing but related devices to assist those with physical disabilities. In one alternative embodiment a diagrammatically shown 'button-loop' grasping device 50 may be coupled to tail member 5 and installed for storage within the handle body cavity until use is required. Such a button loop grasping device 50 may be shaped similarly to hook 17 but with a larger griping opening, and an obviously thinner and slimmer profile so that it may quickly slip through button holes and engage buttons for pulling them back into the buttonhole. As diagrammatically shown in this figure, button-loop grasping device 50 includes a flexible body 52 formed with a loop 54 on its free end. The flexible body 52 may be attached variously, and is shown with optional attachment points 52A, 52B, 52C depending upon a manufacturer's preference. Of course, member 50 may also be loosely stored within chambers 16A, 16B for convenience. It is similarly envisioned that related types of button-acquisition or buttonholing aids may be stored in the handle and optionally affixed to the cap end in combination with the other details noted above and herein.

During operation and use it will become readily apparent that the present device can be operated in a simple and economical manner including the following steps:

Methods for operating the present invention:

(1) Place the clasp between thumb and index finger with the clasp pin pointing upwardly and the chain dangling downwardly. Thereafter, grip body member 3 of clasp device 1 in the opposing hand using the thumb to press down firmly on first clamping member 8 to thereby pressurize biasing spring member 10 and open a distance between first and second clamping jaws 8 and 9.

(2) Stand spring ring 19*b* attached to clasp 19 into receiving structures 12 enabling chain 19*a* to dangle from second clamping jaw 9, as shown.

(3) Release thumb to enable first clamping member to engage clasp pin or lever 19*c* within slot 13*b* and slope 13*a* and to push it into an open position as shown forming opening 19*e*.

(4) Place body member 3 within the palm of the hand the user wishes to wear the bracelet about with clamping member 4 resting on said wrist and said bracelet dangling to an outer wrist direction, as shown preferably within the figures.

(5) Grab the opposing end of clasp 19 (loose ringlet end) with a user's free hand, position free end of chain 19*a* about the user's wrist and secure the opposing ringlet catch ring 19*f* (FIG. 14) catch ring 19*f* within opening 19*e*.

(6) Engage first and second clamping jaws 8 and 9 and release clamping member 4 to enable the release of lever 19*c* from slot 13*b* to thereby close gate 19*d* and retain catch ring 19*f* within spring ring or spring clamp body 19*b*.

It should be obvious to those skilled in the art that alternative spring type clasp devices may be readily engageable with the same fastening device 1.

Figure 10A:
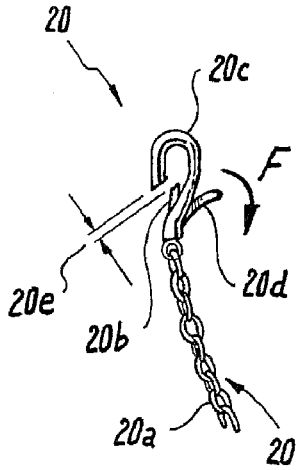
FIG. 10A is an alternative lobster claw spring clamp design according to the conventional art.
Figure 13:
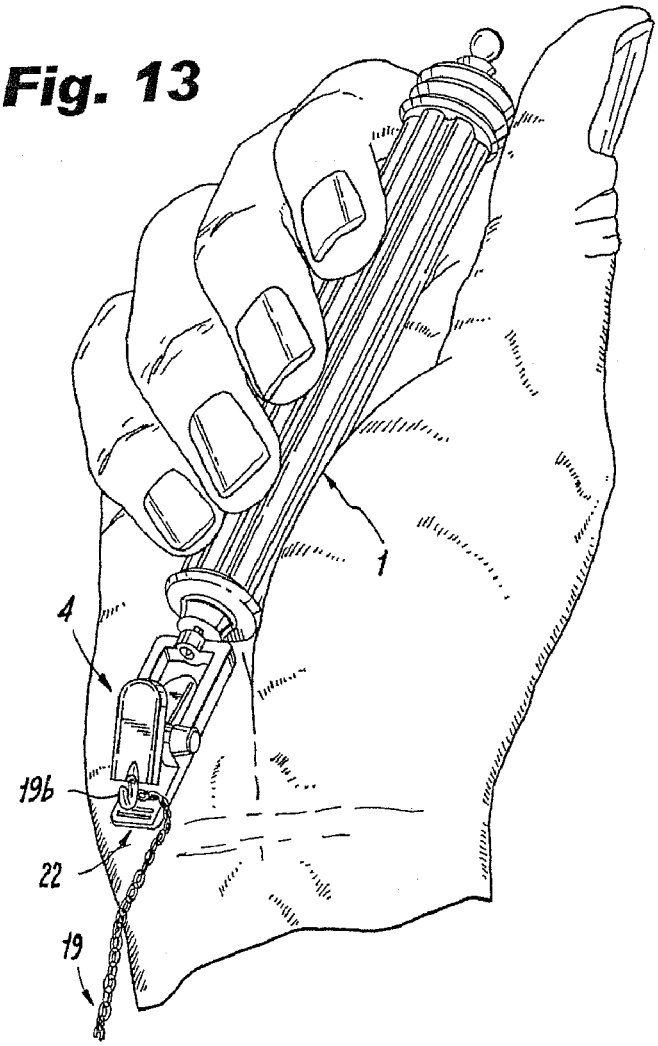
FIG. 13 indicates a held and assembled view according to the present invention. (Step 4)
Figure 14:
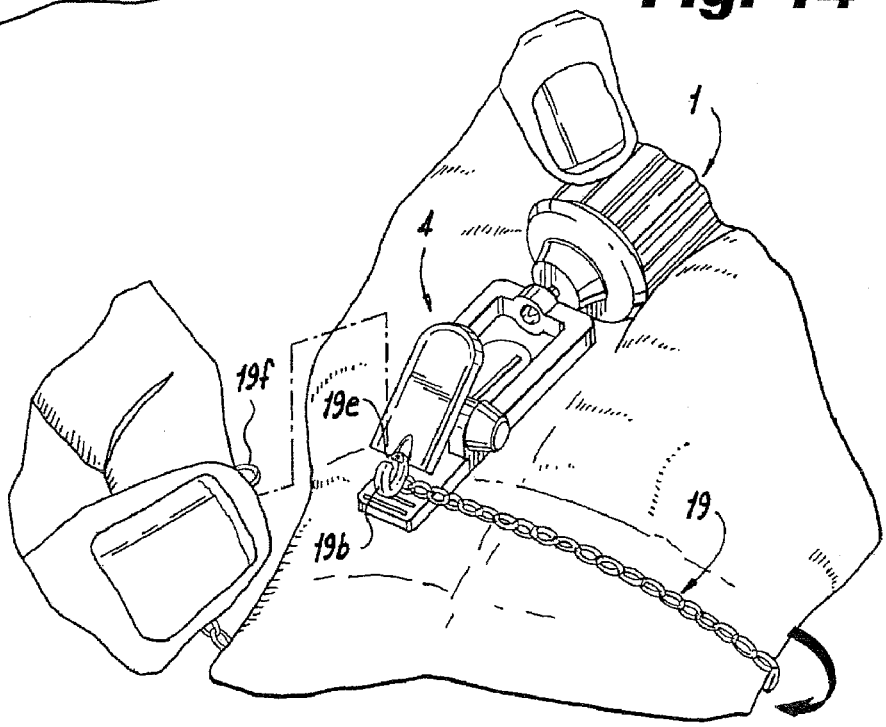
FIG. 14 shows a wrist-assembly view according to another step of the present invention. (Step 5)
Figure 15:
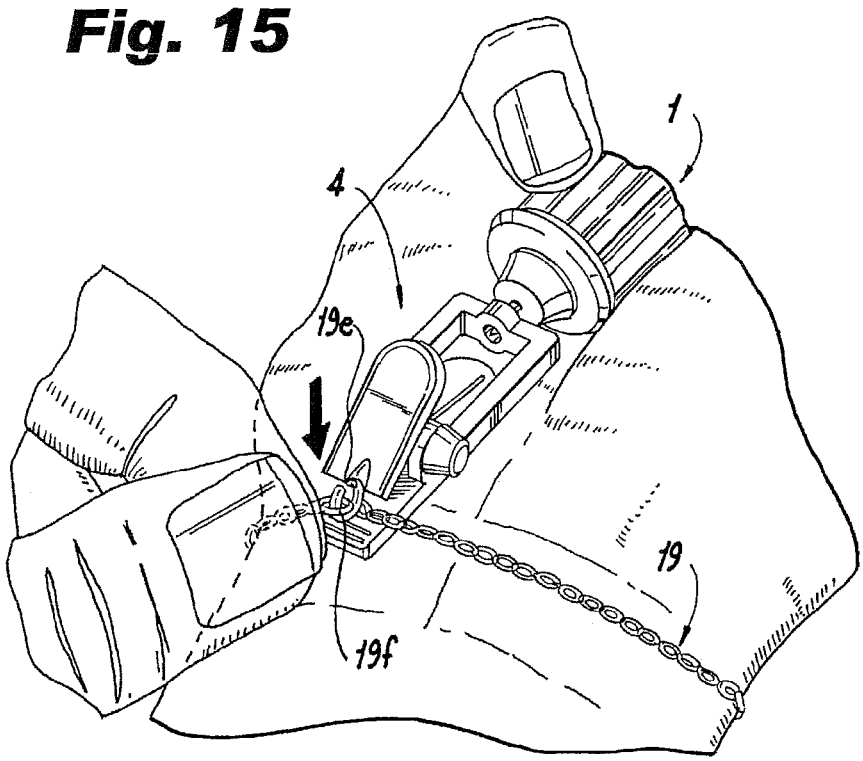
FIG. 15 shows an engaged clasp position according to another step of the present invention. (Step 5)
Figure 16:
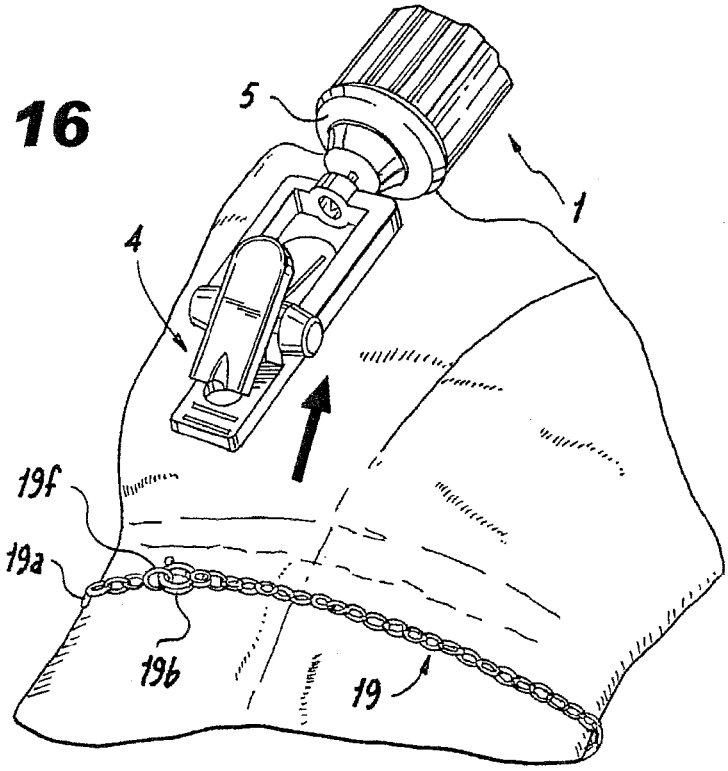
FIG. 16 shows a released and engaged clasp view according to another step of the present invention. (Step 6)

Referring particularly now to FIG. 10A, a claw or claw based (a/k/a "lobster" claw type) bracelet or necklace 20 includes on one end a spring claw or spring clamp body 20*b* formed in the shape of an opening claw having a claw projection 20*c* closeable by a spring lever 20*b* and a spring lever 20*d*. During operation spring lever 20*d* is engaged with force F thereby operating spring claw lever 20*b* forming an opening 20*e* to receive a catch ring formed on an opposite end of a chain 20*a*.

It will be clear to those skilled in the art that both claw based spring clamp jewelry as shown at 20 and spring ring based assembly or clasps shown at 19 may be readily manipulated according to the improvements of the present invention.

Therefore, it will become apparent that the advantages of the present invention include not only a secure travel cavity 16, 16A, 16B within body member 3 but the inclusion and ready operation of anti-tarnishment or anti-desiccant materials within the cavity as well as the particular improvement shown by clamping member 4 and the ease which spring clamp bodies may be manipulated and retained in a hands-free open position thereby enabling a single user operation of all jewelry art.

Additional benefits note that the present structure secures spring rings and claw based spring clamps in a position that prohibits lateral movement or skidding, or unintended separation from clamping member 4 and head member 5. Yet another improvement provided by the present invention is that head member 5 and clamping member 4 may be removed from body member 3 or in fact may be snapped off a rigid body member 3 for repair or replacement or storage within head cavity 16*b*, thereby preserving the integrity of supporting arms 11 and first and second clamping jaws 8 and 9.

In the specification, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

What is claimed is:

1. A hand held fastening aid for disengagingly coupling male and female members of a fastening unit, comprising a body member;

a clamping member coupled to one of opposing ends of the body member; and the clamping member including operative means for receiving, stabilizing and retaining at least one of said male member and said female member of the fastening unit in hands-free engagement with the other one of the male and female member;

the fastening unit comprises a conventional jewelry spring clasp mechanism configured as the female member operative to receive and engage the male member of the fastening unit;

the clamping member being operative to engage and actuate the spring clasp mechanism of the jewelry piece so as to hold the spring clasp mechanism in an open position thereof;

the clamping member has first and second jaws spaced from one end of the body member and pivotable relative to the body member;

the first and second jaws being positionable in an open position and a closed position, wherein in the closed position the first and second jaws are in contact and operative to hold the spring clasp mechanism opened upon actuation and in the open position the first and second jaws are displaced from one another in response to an external force and operative to release the spring clasp mechanism; and further comprising a head member detachably coupled to a distal end of the body member, the clamping member being coupled to the head member so that the body member and clamping member are rotatable and pivotable relative to one another about respective transversely extending axes for adjusting an angular position of the clamping member relative to the body member.

2. The fastening aid of claim 1, wherein the first jaw has an inner surface provided with a positioning indent, the second jaw having a notched free end configured to engage and actuate a lever of the spring clasp mechanism received in the positioning indent.

3. The fastening aid of claim 1, wherein the body member has an inner cavity configured to store the piece of jewelry in a storing position thereof, the inner cavity being provided with a tarnish reducing unit mounted within the cavity to protect the piece of jewelry from being damaged.

4. The fastening aid of claim 1, further comprising a tail member detachably coupled to the other one of the opposite ends of the body member and configured to detachably engage and store the fastening unit within the body member.

5. The fastening aid of claim 1, further comprising:

a button-and-loop arrangement coupled to the other of the opposite ends of the body;

the button-and-loop arrangement having a flexible body and a loop at a free end of the flexible body;

the loop engaging a button configured as the male member of the fastening unit and engaging the button with a garment loop configured as the female member of the fastening unit.

6. A jewelry fastening aid, comprising:

an elongated body member extending along a longitudinal axis;

a clamping member coupled to a distal end of the body member and operative to receive, stabilize, and hold in an open position a conventional jewelry spring clasp mechanism of a piece of jewelry while allowing a wearer to removably fasten the piece of jewelry to a body of the wearer in hands-free engagement;

wherein the clamping member has first and second jaws configured to pivot relative to one another about a pivot axis, extending transversely to the longitudinal axis, to removably engage and open the spring clasp mechanism of the piece of jewelry; and further comprising a rotational unit having an axial stop on the distal end of the body member and a pair of gripping arms, the gripping arms being coupled to the axial stop and the first and second jaws so as to provide the clamping and body members with controllable rotation relative to one another about the longitudinal axis.

7. The jewelry fastening aid of claim 6, further comprising a pivoting unit operative to pivot the first and second jaws and the body member relative to one another about the pivot axis, the first and second jaws being pivotable about the pivot axis relative to one another between a closed position, in which distal ends of the respective jaws are displaced towards one another so as to open the spring clasp mechanism, and an open position, in which the distal ends of the respective first and second jaws are spaced apart for releasing the spring clasp mechanism.

8. The jewelry fastening aid of claim 7, further comprising a spring biasing mechanism mounted to the pivoting unit and coupled to the first and second jaws so as to generate a spring force biasing the first and second jaws to the closed position, the first and second jaws being displaced towards the open position in response to an external force applied thereto and exceeding the spring force.

9. The jewelry fastening aid of claim 6, wherein one of the first and second jaws has a surface provided with a seat for receiving the piece of jewelry, and at least one formation next to the seat to provide an enhanced grip between a hand of the wearer and the clamping member.

10. The jewelry fastening aid of claim 9, wherein the other one of the first and second jaws has a tipped region provided with a slanted surface, the slanted surface being configured to engage a lever of the spring clamp of the piece of jewelry, received in the seat, and displace the lever so as to open the spring clamp mechanism while the wearer fastens the piece of jewelry to the wearer's body.

11. The jewelry fastening aid of claim 6, further comprising a head member coupled to the clamping member and removably mounted to the distal end of the body member, and a tail member removably coupled to a proximal end of the body member, the body member being provided with at least one inner cavity bounded on opposite axial ends thereof by the respective head and tail members and configured to receive and store the piece of jewelry.

12. The jewelry fastening aid of claim 11, wherein the head member has opposite head member ends selectively engageable with the thread of the body member to store the clamping member in a non-use position thereof in the cavity of the body and to expose the clamping member in a use position thereof.

13. The jewelry fastening aid of claim 12, wherein the clamping and body members are fixed to one another.

14. The jewelry fastening aid of claim 12, further comprising a tarnish reducing unit mounted within the cavity of the body member and configured to prevent the piece of jewelry from being damaged.

15. The jewelry fastening aid of claim 11, wherein the tail member has a tail member body removably engaging the body member, a clip mounted to the tail member body and provided with a retaining flexible limb, the retaining flexible limb being displaceable in response to an external force to releasably engage the spring clasp mechanism for displacing the piece of jewelry into and from the at least one inner cavity of the body member.

* * * * *